US010538960B2

(12) United States Patent
Nanba

(10) Patent No.: US 10,538,960 B2
(45) Date of Patent: Jan. 21, 2020

(54) SLAT WITH PRESSURE CONTACT PART AND BLIND USING SAME

(71) Applicant: BUNKA, INC., Yokkaichi, Mie (JP)

(72) Inventor: Shuji Nanba, Mie (JP)

(73) Assignee: BUNKA, INC., Yokkaichi, Mie (JP)

( * ) Notice: Subject to any disclaimer, the term of this patent is extended or adjusted under 35 U.S.C. 154(b) by 0 days.

(21) Appl. No.: 15/746,684

(22) PCT Filed: Sep. 6, 2016

(86) PCT No.: PCT/JP2016/076179
§ 371 (c)(1),
(2) Date: Jan. 22, 2018

(87) PCT Pub. No.: WO2017/043487
PCT Pub. Date: Mar. 16, 2017

(65) Prior Publication Data

US 2018/0209212 A1 Jul. 26, 2018

(30) Foreign Application Priority Data

Sep. 7, 2015 (JP) ..... 2015-175410

(51) Int. Cl.
*E06B 9/266* (2006.01)
*E06B 9/36* (2006.01)
*E06B 9/386* (2006.01)

(52) U.S. Cl.
CPC ..... *E06B 9/266* (2013.01); *E06B 9/36* (2013.01); *E06B 9/386* (2013.01)

(58) Field of Classification Search
CPC . E06B 9/266; E06B 9/386; E06B 9/36; E06B 7/084; E04H 17/143
See application file for complete search history.

(56) References Cited

U.S. PATENT DOCUMENTS 390,392 A * 10/1888 Niss ..... E06B 9/307 160/175
702,148 A * 6/1902 Nettleton ..... E06B 7/084 49/403

(Continued)

FOREIGN PATENT DOCUMENTS

JP 657280 U 8/1994
JP H06288164 A 10/1994

(Continued)

OTHER PUBLICATIONS

Written Opinion of the International Searching Authority corresponding to Application No. PCT/JP2016/076179; dated Oct. 4, 2016.

*Primary Examiner* — Katherine W Mitchell
*Assistant Examiner* — Abe Massad
(74) *Attorney, Agent, or Firm* — Cantor Colburn LLP

(57) ABSTRACT

A slat for use in a window frame having opposing walls may include a wing portion structured to block light, the wing portion having a first end in a longitudinal direction and a second end opposite to the first end; and a first pressure contact part provided at the first end and a second pressure contact portion provided at the second end, the first pressure contact part and the second pressure contact part being structured to press the wing portion against the opposing walls of the window frame to thereby hold the wing portion in place.

8 Claims, 8 Drawing Sheets

(56) References Cited

U.S. PATENT DOCUMENTS

| | | | | | |
|---|---|---|---|---|---|
| 1,582,111 | A * | 4/1926 | Wogan | E06B 7/084 | 160/104 |
| 2,311,122 | A * | 2/1943 | Niesner | E06B 7/084 | 454/221 |
| 2,346,057 | A * | 4/1944 | Touchstone | E06B 7/084 | 160/115 |
| 2,359,906 | A * | 10/1944 | Gardner | E06B 7/084 | 160/91 |
| 4,027,430 | A * | 6/1977 | Sakamoto | E06B 7/084 | 49/403 |
| 4,709,506 | A * | 12/1987 | Lukaszonas | E06B 9/367 | 454/318 |
| 5,339,591 | A * | 8/1994 | Underdahl | E06B 7/082 | 49/74.1 |
| 7,032,891 | B2 * | 4/2006 | Rowley | E04H 17/143 | 256/26 |
| 8,474,187 | B2 * | 7/2013 | Marocco | E06B 7/086 | 49/403 |
| 9,574,392 | B2 * | 2/2017 | Alexander | E06B 7/084 | |
| 2004/0031233 | A1 * | 2/2004 | Cope | E06B 7/084 | 52/769 |

FOREIGN PATENT DOCUMENTS

| | | | |
|---|---|---|---|
| JP | H10196238 | A | 7/1998 |
| JP | 3090006 | U | 9/2002 |
| JP | 2004225397 | A | 8/2004 |
| JP | 2005120612 | A | 5/2005 |
| JP | 2006167650 | A | 6/2006 |
| JP | 2009183362 | A | 8/2009 |
| JP | 2009235670 | A | 10/2009 |
| JP | 2014043707 | A | 3/2014 |
| WO | 9812409 | A1 | 3/1998 |

* cited by examiner

30 Connecting pin

30 Connecting pin

SLAT WITH PRESSURE CONTACT PART AND BLIND USING SAME

CROSS REFERENCE TO RELATED APPLICATIONS

This is the U.S. national stage of application No. PCT/JP2016/076179, filed on Sep. 6, 2016. Priority under 35 U.S.C. § 119(a) and 35 U.S.C. § 365B is claimed from Japanese Application No. 2015-175410, filed on Sep. 7, 2015; the disclosure of which are incorporated herein by reference.

TECHNICAL FIELD

At least an embodiment of the present invention relates to a slat of a blind for use in a window frame.

BACKGROUND

At least an embodiment of the present invention relates to a structure of a slat with a pressure contact part marketed as a standalone product, and a blind which a user can assemble by himself or herself depending on his or her taste with a plurality of slats pressed against and held on the opposite wall in a window frame at a prescribed interval. The pressure contact part is made up of, for example, a commercially available tension rod. The Japanese patent application serving as a basis for claiming a right of priority for the present application has been subjected to accelerated examination and has already been registered as the Japanese Patent NO. 5927737.

Blinds, which are provided on a window for adjustment of sunshine shielding or for preventing a user from being seen from outside the window, are classified into a transverse blind having slats horizontally and continuously suspended and a vertical blind having slats vertically and continuously suspended. The transverse blind is used with the slats that are horizontally held, and opened and closed by the operation of a plurality of ladder cords vertically suspended from a headrail. Further, the vertical blind is used by opening and closing the slats that are vertically and continuously suspended from a headrail. Both the transverse blind and the vertical blind serve as blinds when the slats, an operating rod, the ladder cords, and the headrail are integrally operated. The blind is usually connected to a bracket secured to one side of a window frame and installed so as to cover the entire surface of a window.

The blind as described above is installed by securing the headrail to a bracket screwed at an optional position using a driver or the like. The blind is designed to cover the entire opening area of the window so that the number of required slats is in proportion to the increase in the opening area. However, the number of slats constituting a general blind is preliminarily determined at the time of production; it is usually difficult for a user to adjust the number of slats at the scene in accordance with the opening area of a window where a blind is installed; and today's distribution system makes it difficult for a user to purchase slats only for assembling a blind by himself or herself.

Further, a method for installing a blind by connecting the blind to the bracket makes it easy to attach and detach the blind for maintenance once the bracket is installed. However, a tool such as a driver is required for the installment of a bracket and the bracket tends to be installed in high places, and therefore the installment of a blind using a bracket is not that easy for general users. Further, the slats covering the entire window surface increases the number of slats that are made up of a thin metal plate or cloths so that cleaning and maintenance needs delicate care, and therefore the general users can hardly do maintenance works themselves with a sense of DIY. Furthermore, the slats are configured to open or close simultaneously at the same angle, and thus cannot be adjusted to partially open or close for partial shielding. Further, the conventional blind has the following structural defects: when a window is opened for the purpose of ventilation, slats are likely to be fanned by winds, thus making unpleasant sounds when colliding with a nearby sash, potentially causing damage to both sides.

In order to solve the above-described existing problems, the Japanese Patent Publication No. 2014-043707 or the Japanese Patent Publication No. 2004-225397 discloses a blind including a guide cord that is vertically arranged from the vicinity of the right and left ends of the blind body with the slats passing through the guide cord to thus prevent the slats from being fanned and warped. Alternatively, a bottom rail clipping member preliminarily provided on the bottom end of a blind is disclosed for clipping the bottom rail when the blind is pulled down to the lowermost position in order to prevent the slats from being fanned by winds. However, any of these solutions additionally needs a guide cord or a slat holding member, and thus installment becomes complex and burdensome. Further, the Japanese Patent Publication No. 2009-235670 or the Japanese Patent Publication No. 2005-120612 discloses a blind capable of setting the open and close range to allow the slats to partially open and close, however the open and close range is restricted to within a certain range; thus, there is no description about adjustment of shielding and sunshine in accordance with a specific user-intended range.

Further, the Japanese Utility Model Publication No. 1994-57280 discloses a roll curtain that is installed on a window frame or the like. The roll curtain is secured to a window frame using a tension rod, and is also configured to serve as a blind. However, the structure for covering the opening of a window in accordance with a specific user-intended range has yet to be achieved even with this structure. Further, the Japanese Utility Model Registration No. 3090006 discloses louver window fittings that are easily detachable and attached to a support post, however the structure for covering the opening of a window in accordance with a specific user-intended range has yet to be achieved either with this structure because the louver window fittings themselves are configured to have a prescribed size. Furthermore, the Japanese Patent Publication No. 2003-183362 discloses an easy attachment type curtain attachable to a tension rod, however this curtain also has a predetermined size, and therefore the shielding range cannot be flexibly changed.

That is, the cited references do not disclose at least a technical idea of the present application: "slats are marketed as standalone products and a purchaser assembles a blind by himself or herself with a sense of DIY using the slats purchased as standalone products." The cited references only disclose the structure relating to a blind with the slats incorporated therein or a louver. As described above, the Japanese patent application serving as a basis for claiming a right of priority for the present application has been subjected to accelerated examination and has already been registered as the Japanese Patent NO. 5927737. The patent examiner at the Japanese Patent Office rejected the Japanese patent application during the prosecution of the patent, alleging that a blade 2 disclosed in the Japanese Patent Publication No. 2006-16765 is equivalent to that of the present application. However, the applicant of the Japanese patent application counterargued that a person skilled in the art could not be motivated to use the blade 2 disclosed in the cited reference as the structural component in the present application. The examiner was persuaded by the counterargument so that the Japanese application was eventually registered as the patent No. 5927737.

PATENT DOCUMENTS

Patent Document 1: Japanese Patent Publication No. 2014-043707

Patent Document 2: Japanese Patent Publication No. 2004-225397

Patent Document 3: Japanese Patent Publication No. 2009-235670

Patent Document 4: Japanese Patent Publication No. 2005-120612

Patent Document 5: Japanese Utility Model Publication No. 1994-57280

Patent Document 6: Japanese Utility Model Registration No. 3090006

Patent Document 7: Japanese Patent Publication No. 2009-183362

As described above, the slats in known blinds are different from the slats of the present application: "slats are marketed as standalone products and a purchaser assembles a blind by himself or herself with a sense of DIY using the slats purchased as standalone products." That is, the conventional slats cannot work without being combined with a headrail that shares operation functions with an operating rod, a ladder cord and so on, and are not configured to work by itself as standalone slats. Further, the size of the slats in the existing blind is determined at the time of production, and therefore there is a problem that a purchaser cannot flexibly set the size of the slats to fit in a window frame at the site where the blind is installed. There is also a problem that the opening and closing angle of slats must be uniformly set and each slat cannot be individually addressed. There is further a problem that the design for the blind gives a simple, monotonous and cold impression to a viewer as a whole.

SUMMARY

At least an embodiment of present invention provides a strip shaped slat with a pressure contact part as a standalone item for a blind. The slat is characterized by a structure composed of two components: a light shielding wing portion and a pressure contact part provided on both short sides of the wing portion for pressing and holding the wing portion against the opposing walls in a window frame along a vertical direction or a horizontal direction. The pressure contact part is constituted by a commercially-available extendable and retractable tension rod, a screw mechanism or the like, and a hollow cylinder is provided for housing the tension rod biased along a longitudinal direction of the wing portion or a screw of the screw mechanism. The wing portion is configured to rotate about the tension rod or a center axis of the screw mechanism that are housed in the hollow cylinder, and thus the opening and closing angle of the slat can be individually and flexibly adjusted by manual rotating operation. The planar shape of the above-described wing portion is flexible, and the wing portion is configured to allow a flexible planar design to be added.

At least an embodiment of the present invention further allows a user to purchase any suitable number of the slats with pressure contact parts as standalone items to conform to the length between opposing walls in a window frame; the user can assemble a blind depending on his or her taste by arranging the slats to be mutually spaced apart while being pressed and held between the opposing walls via the pressure contact parts by himself or herself with a sense of DIY. In this case, the mutually adjacent slats may be connected regularly spaced apart from each other via a connecting pin.

Additionally, the slat with a pressure contact part may be made of a material easy to cut with scissors so that a part of the wing portion can be cut off to adjust a length when the length of the wing portion of the blind is excessively longer than the width of the window frame. On the other hand, when the length of the wing portion in the blind is excessively shorter than the width of the window frame, the length of the wing portion can be extended using a cylindrical extension wing portion that is configured to extend and retract while sandwiching the wing portion from the front and rear sides near the short side of the wing portion.

The slats with pressure contact parts according to at least an embodiment of the present invention are standalone items so that a user may purchase any suitable number of slats depending on the size of a window frame, and the user can assemble a blind depending on his or her taste by arranging the purchased slats side by side to be continuously pressed between the opposing walls in a window frame. Further, the user can also achieve the effect of desirable shielding adjustment by rotating only a part of slats corresponding to an optional position or range and adjusting the opening angle of the slats. It is also possible to easily install the slat with pressure contact parts without the need of any tools in the same manner as in the installment of a commercially available tension rod. Further the slats can be installed both in a horizontal direction or in a vertical direction with the tension rods being pressed and attached between the opposing walls in a window frame and thus making it possible to conveniently install a blind without leaving any screw holes especially in a rental house. As such, the slat with a pressure contact part according to at least an embodiment of the present invention has the advantage of allowing efficient operation at the time of installment.

Further, the blind according to at least an embodiment of the present invention is composed of independently usable slats which allows a user to purchase only the necessary number of slats for cost saving. Each slat is also easily detachable and thus has the advantage of facilitating maintenance such as cleaning.

Further, the slat with a pressure contact part according to at least an embodiment of the present invention is not simply hung as in the conventional blind but is pressed and held between opposing walls in a window frame while keeping a prescribed opening and closing angle so that the slat is not fanned even with winds. Therefore, the slat is prevented from colliding with nearby fittings and thus has the advantage of eliminating any concern over collision sounds and damage thereto.

Further, the slat with a pressure contact part is capable of changing the color, pattern, material, shape and the combination thereof by replacing others, thereby easily adding decorations thereto; the user is capable of creating his or her own design for a blind by combining slats depending on his or her taste; thus the slat has the advantage of improving the design.

Further, the slat with a pressure contact part according to at least an embodiment of the present invention makes it possible to market a wing portion and a pressure contact part individually and separately, thereby allowing a user to paint the wing portion or alter the shape thereof. The user can also replace the tension rod with various types of commercially available tension rods and create a slat with a pressure contact part based on his or her own preference. As such, the slat according to at least an embodiment of the present invention has the advantage of being marketed individually and separately in a marketing method different from the conventional marketing method for blinds.

Furthermore, the slat with a pressure contact part may be made to have an elongated length and then cut to the necessary length, and the wing portion may be made slidable in the extension direction. As such, the slat has the advantage of meeting a user's specific request for the size.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

Figure 1:
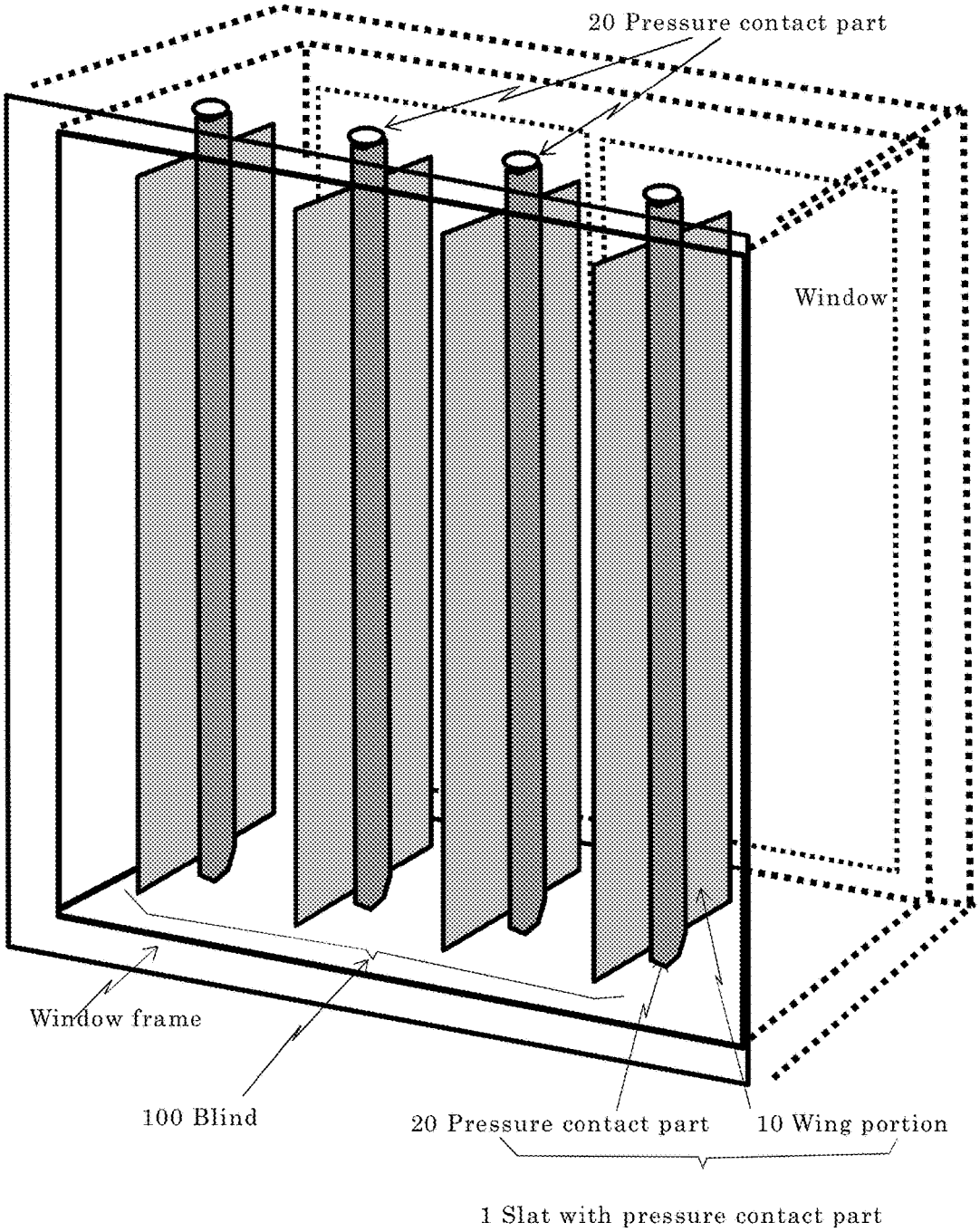
FIG. 1 is a perspective view illustrating slats with pressure contact parts according to at least an embodiment of the present invention that are pressed and installed side by side between opposing walls of a wind frame to constitute a blind.

FIG. 1 is a perspective view seen from the inside of a room, illustrating slats 1 with pressure contact parts constituting a blind 100 according to at least an embodiment of the present invention that are installed side by side between vertically opposing walls of a wind frame by compressing pressure contact parts 20. Although FIG. 1 illustrates a vertical blind 100 wherein the strip shaped slats 1 with pressure contact parts are compressed between vertically opposing walls in a window frame, the blind 100 may also be constituted as a transverse blind wherein the pressure contact parts 20 of the slats 1 with pressure contact parts are compressed between the horizontally opposing walls of the window frame. FIG. 1 shows the blind 100 composed of four slats 1 with pressure contact parts, but the necessary number of slats 1 with pressure contact parts according to at least an embodiment of the present invention may be used to fit in the window frame. As described above, the blind 100 according to at least an embodiment of the present invention is different from a conventional blind equipped with slats having a predetermined size at the time of production so that a user may purchase an optional number of slats 1 with pressure contact parts that matches the size of the window frame, attaching the slats 1 to be pressed between the opposing walls of the window frame. As such, the blind 100 may help to create a neat design and also improve flexibility in design.

Further, the slats 1 with pressure contact parts can be individually opened and closed by manually rotating the wing portions 10. Therefore, the slats 1 has the advantage of blocking a necessary part of the outer light entering a room and has a structure different from conventional slats that are all together held at the same opening and closing angle, for example, by using a ladder cord. Although FIG. 1 shows the opposing walls in a window frame that are provided inside a room, the opposing walls may extend outside the window depending on the types of the window frame. The blind 100 can be installed in such a window frame by mounting the slats 1 with pressure contact parts according to at least an embodiment of the present invention to be pressed between the opposing walls outside the window. As described above, the user can assemble a blind 100 with a sense of DIY by purchasing an optional number of the slats 1 with pressure contact parts as standalone items and by arranging the optional number of slats to be mutually spaced apart depending on his or her taste. As a matter of course, the blind 100 has the advantage of blocking sunlight or visibilities from the outside flexibly depending on the number of the slats 1 mutually spaced apart as described above.

Figure 2A:
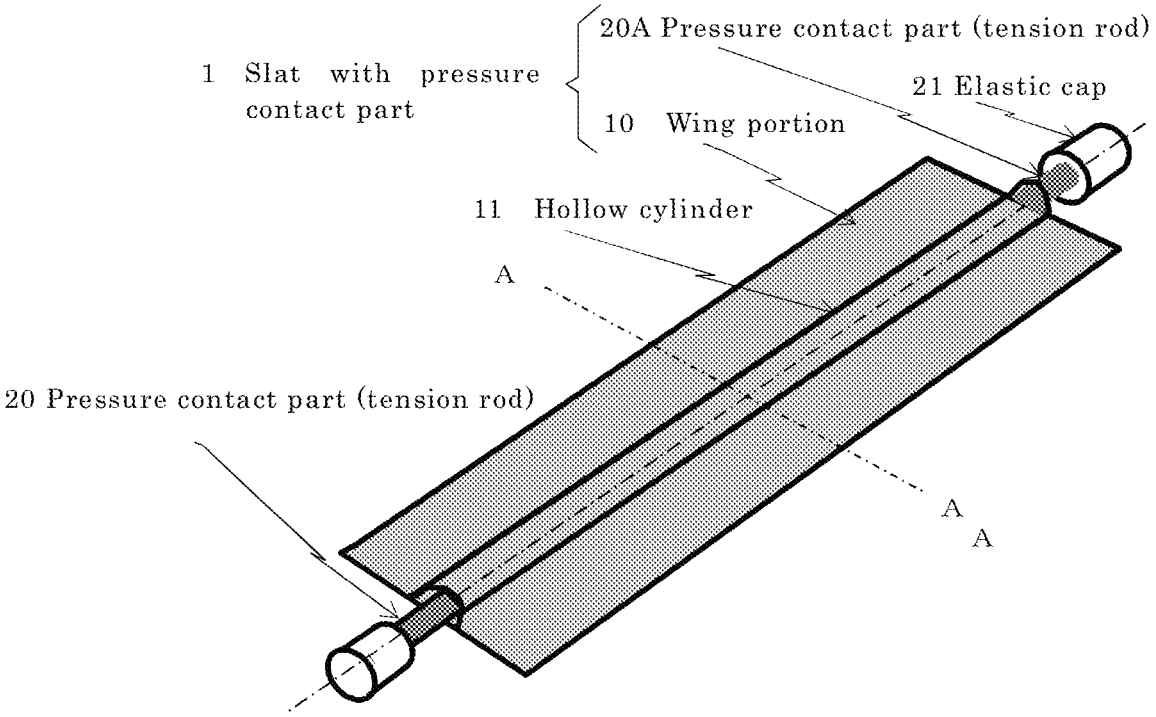
FIGS. 2A-2B is a perspective view illustrating a slat with a pressure contact part according to at least an embodiment of the present invention with a tension rod constituting the pressure contact part being inserted into a hollow cylinder that is provided along the longitudinal direction of a wing portion.
Figure 2B:
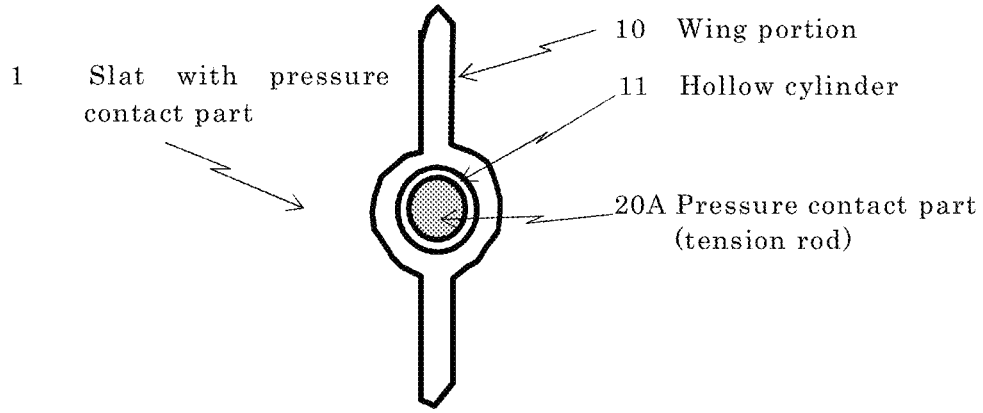

FIG. 2A-2B is a perspective view illustrating a slat 1 with a pressure contact part according to at least an embodiment of the present invention with a tension rod 20A constituting a pressure contact part 20. That is, as shown in FIG. 2A, the tension rod 20A is inserted into a hollow cylinder 11 provided along the longitudinal direction of a wing portion 10 with an elastic cap 21 made of a lubber or the like, mounted on both ends. The tension rod 20A is a commercially available extendable rod composed of an elongated pipe and an elongated slide rod that has a smaller diameter than the pipe and is used tightly inserted into the pipe. The tension rod 20A has a well-known slide lock mechanism configured such that when the slide rod is rotated in one direction relative to the pipe the slide rod is locked in a non-slidable state, and when the slide rod is rotated in the opposite direction the slide rod is unlocked to allow the tension rod to extend or retract. FIG. 2B is a cross-sectional view of FIG. 2A taken along the line AA. The tension rod 20A in the drawing is configured to rotate inside the hollow cylinder 11 in the wing portion 10, and thus when the slat 1 with a pressure contact part is pressed and held between the opposing walls of the window frame as shown in FIG. 1, each wing portion 10 can be rotated about the tension rod to thereby allow the user to easily perform shielding adjustment by manually rotating each wing portion 10.

The wing portion 10 may be made of a thin film like material such as a generally-used slat material. Further, in order to prevent the wing portion 10 from excessively rotating inside the hollow cylinder 11 due to winds blowing through the open window, irregularities (not shown) are formed on the inner surface of the hollow cylinder 11 so that an opening and closing angle of the slats can be maintained by a suitable rolling friction. In this regard, the slat 1 has a different structure than the structure where a curtain is simply suspended from an extension rod as in so-called a café curtain.

Further, a commonly used blind has slats each having a wing portion with a short width of approximately 25 mm to 50 mm, whereas the slat 1 with a pressure contact part according to at least an embodiment of the present invention has a hollow cylinder 11 and thus is hardly curved compared to a conventional blind even in the case of a transverse blind. Therefore, the wing portion 10 may have a wide width of 200 mm or greater, and thus the wide width may also have the advantage of facilitating various types of designs on the wing portion 10. Although the hollow cylinder 11 is provided at the center of the short side of the wing portion 10 in the drawing, the hollow cylinder may be positioned either on the right side or left side along the short side of the wing portion in terms of design.

Figure 3:
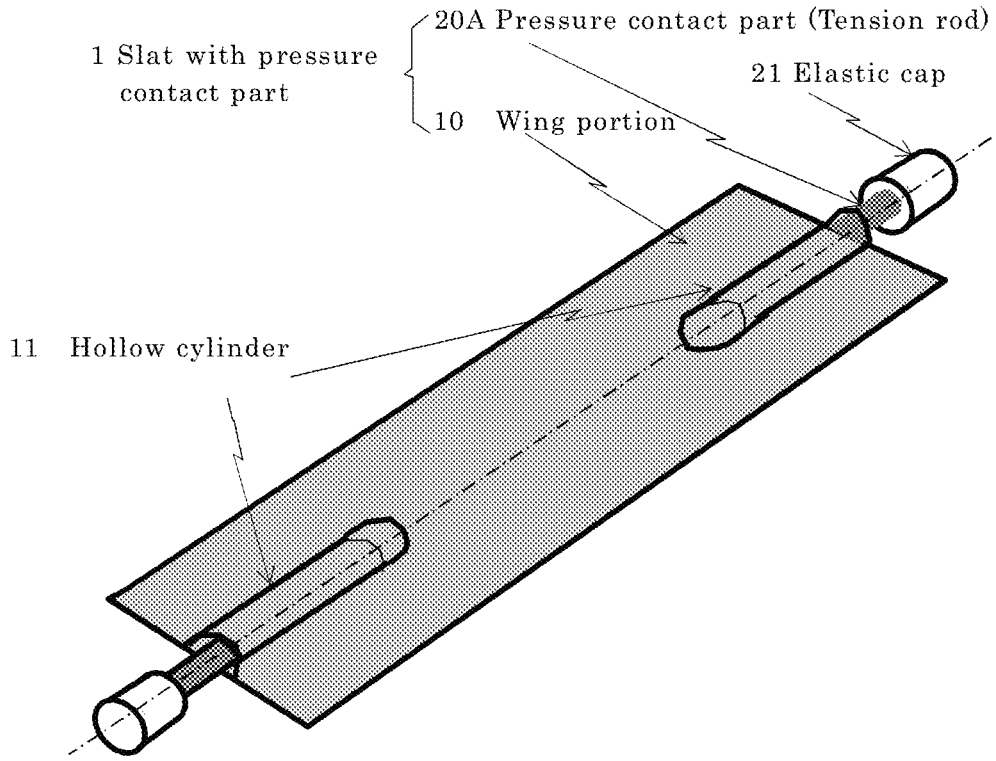
FIG. 3 is a perspective view illustrating a slat with a pressure contact part according to at least an embodiment of the present invention with tension rods constituting the pressure contact part being inserted into hollow cylinders that are provided at both ends of the wing portion along the longitudinal direction thereof.

FIG. 3 illustrates a slat 1 with a pressure contact part according to another embodiment. That is, hollow cylinders 11, which are shorter than the hollow cylinder shown in the embodiment in FIGS. 2A-2B, are provided only on both ends near the short side of the wing portion 10 with tension rods 20A inserted therein. With this configuration, the entire part of the wing portion 10 needs rigidity, the wing portion 10 must be constituted by a relatively thick material rather than the thin film like material.

Figure 4:
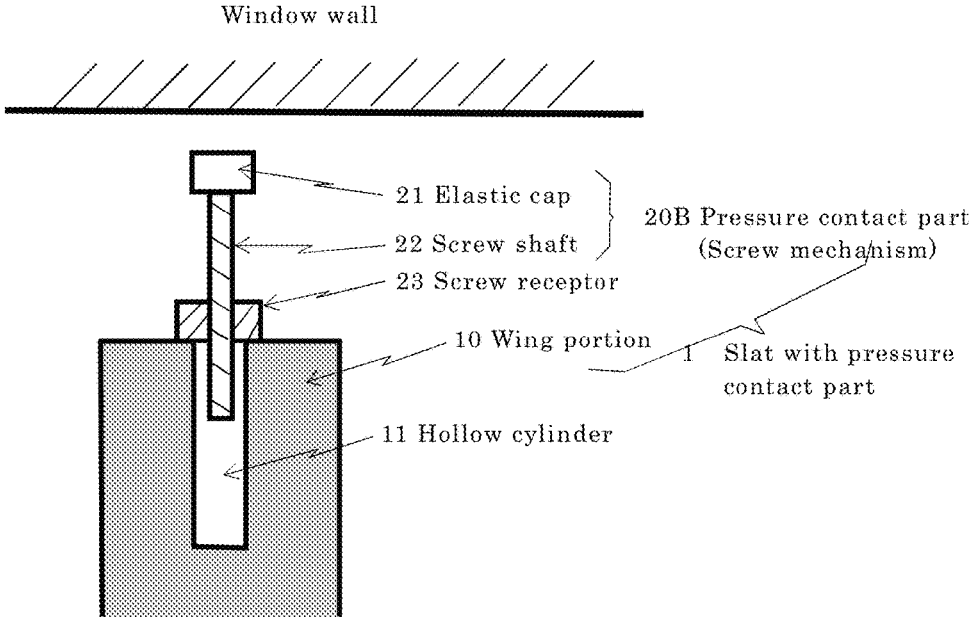
FIG. 4 is a front view illustrating another embodiment of the pressure contact part.

Although FIGS. 2A-2B and 3 illustrate structures where the tension rods 20A are inserted into the hollow cylinder 11 of the wing portion 10 to rotate inside the hollow cylinder, the slat 1 with a pressure contact part is not limited to these structures. The pressure contact part 20 may be constituted by a simple screw mechanism 20B composed of a screw shaft 22 and a screw receptor 23 wherein a screw is adapted to advance and retract as shown in FIG. 4, thereby advancing elastic caps 21 at both ends and causing the elastic caps 21 to be pressed between the opposing walls in the window frame. With this configuration, when the wing portion 10 is rotated, the screw receptor 23 is manually unfastened with respect to the screw shaft 22, then the wing portion 10 is rotated at a prescribed angle, thereafter, the screw receptor 23 is rotated again to thereby press the elastic caps 21 against the opposing walls in the window frame. In this case, the diameter of the screw receptor 23 is preferably increased to facilitate the manual rotation of the screw receptor 23.

Figure 5:
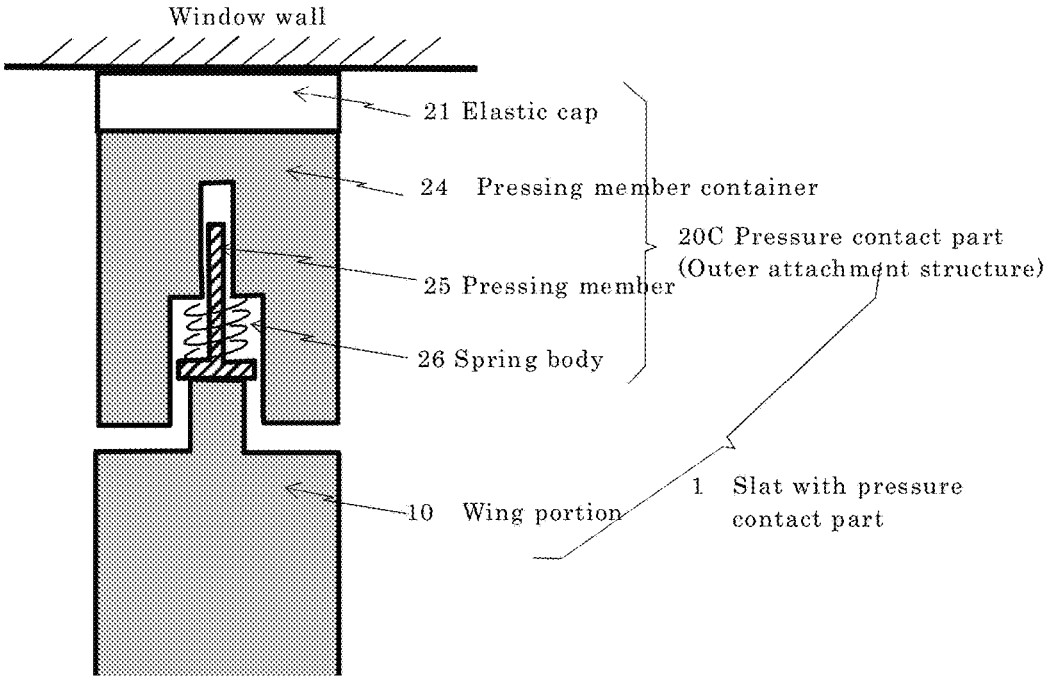
FIG. 5 is a front view illustrating yet another embodiment of the pressure contact part.

FIG. 5 is a front view illustrating yet another embodiment of the pressure contact part 20. Here in the embodiment, the pressure contact part 20 is constituted by an outer attachment structure 20C independently provided at the outer side along the axial direction of the wing portion 10. In this outer attachment structure 20C, a pressing member 25 stored in a pressing member container 24 is biased toward the wing portion 10 by a spring body 26. That is, the pressing member 25 is presses against the end face of the wing portion 10 by the spring body 26 while the elastic cap 21 is pressed against and held by the opposing wall in the window frame at the same time. In this case, the pressing member 25 is pivotable in the pressing member container 24, and thus the wing portion 10 pressed against and held by the opposing wall is manually pivotable about the axis to thereby enable a flexible opening and closing angle.

Various types of structures of the pressure contact part 20 may be applied besides those described above, however, the pressure contact part 20 according to at least an embodiment of the present invention may include other structures as long as the opening and closing angle of the wing portion 10 can be manually and flexibly set with the elastic cap 21 pressed against the opposing wall in the window frame at one end while being pressed against the wing portion 10 at the other end, and therefore the pressure contact part 20 is not limited to the structures as described above.

Figure 6:
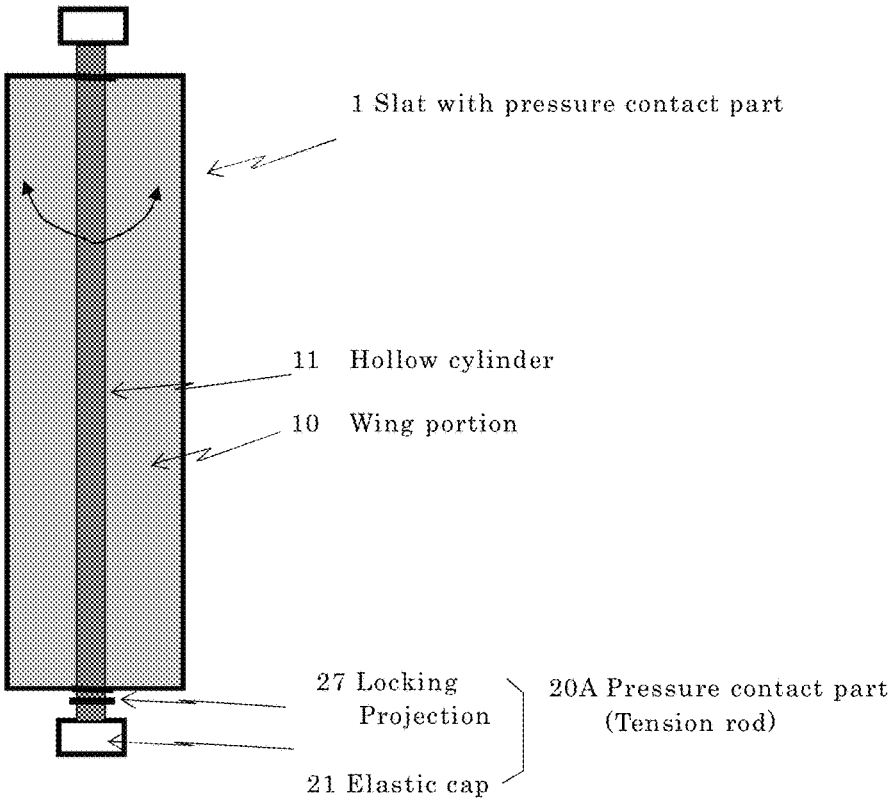
FIG. 6 is a front view illustrating the slat with a pressure contact part according to at least an embodiment of the present invention.
Figure 7:
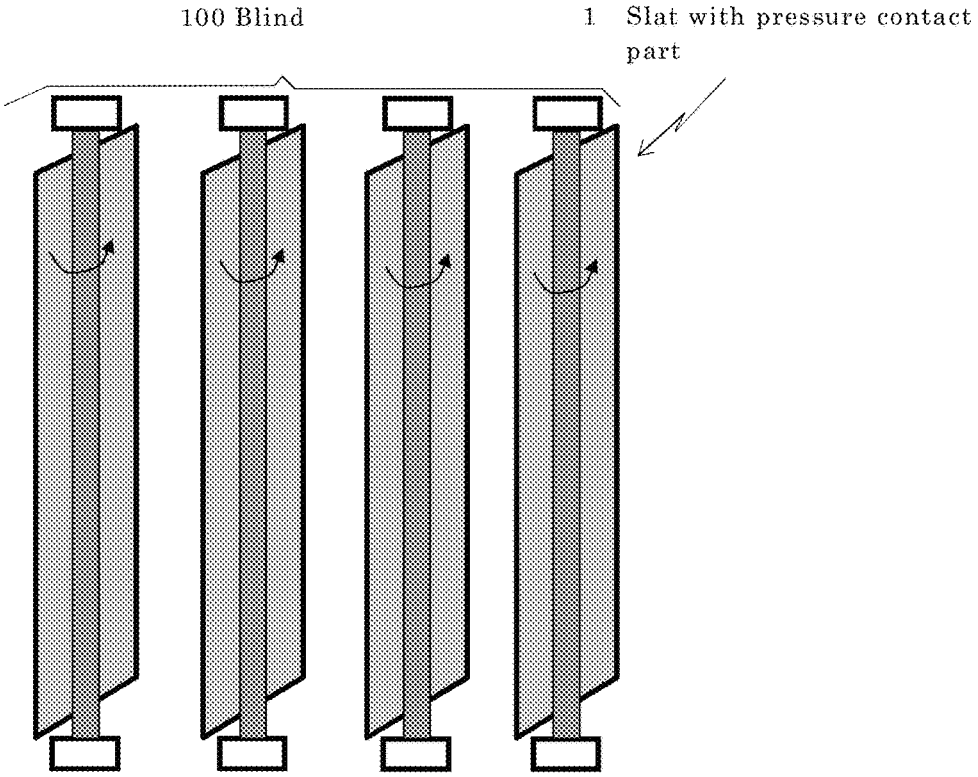
FIG. 7 is a front view illustrating the slat with a pressure contact part according to at least an embodiment of the present invention with a wing portion being rotated.

FIG. 6 is a front view illustrating the slat 1 with a pressure contact part according to at least an embodiment of the present invention when the wing portion 10 faces front. FIG. 7 is a front view when the wing portion 10 is rotated. The manual rotation of each slat 1 allows the wing portion 10 to rotate at an optional opening and closing angle. A locking projection 27 may be provided below the tension rod to hold the wing portion 10 at a prescribed position as shown in FIG. 6.

Figure 8:
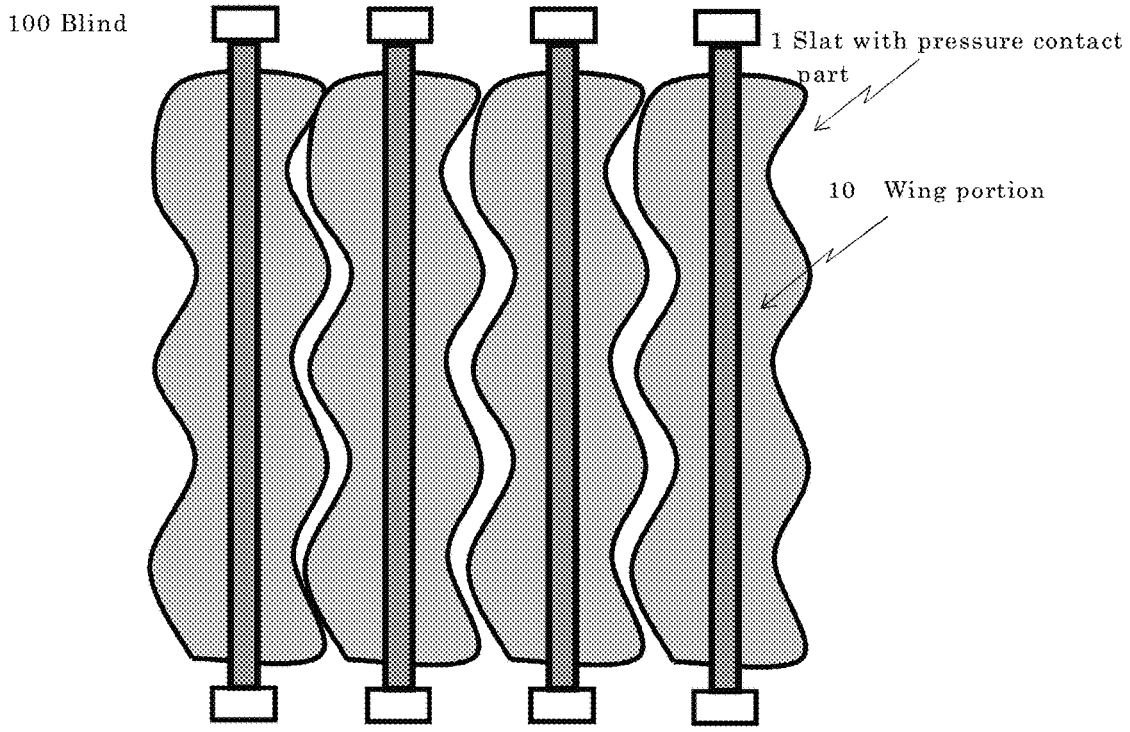
FIG. 8 is a front view illustrating the slat with a pressure contact part according to at least an embodiment of the present invention with the wing portion having another shape.
Figure 9:
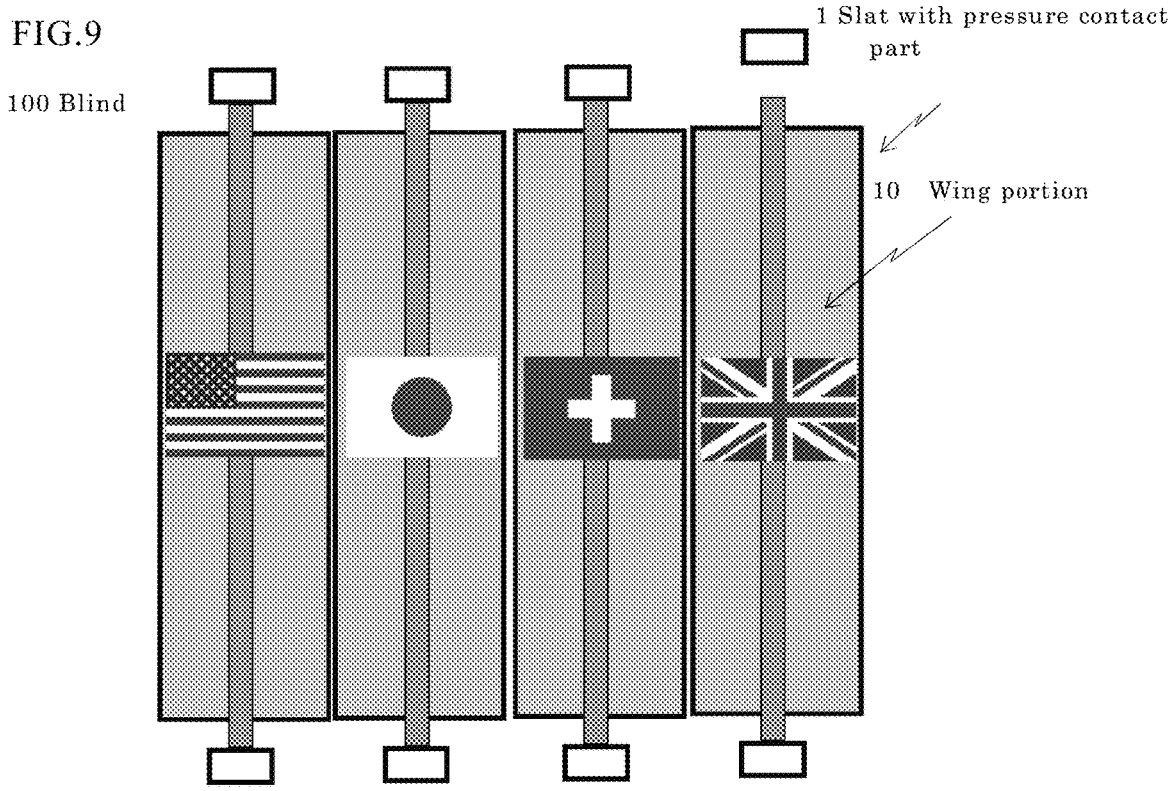
FIG. 9 is a front view illustrating the slat with a pressure contact part according to at least an embodiment of the present invention with the wing portion having an optional design added thereto.

FIG. 8 is a front view illustrating the slat 1 with a pressure contact part according to at least an embodiment of the present invention with the wing portion 10 having another shape. That is, the wing portion 10 may be formed into different shapes for each the slat 1 with a pressure contact part. Further, as shown in FIG. 9, optional designs may be applied to each wing portion 10.

Figure 10A:
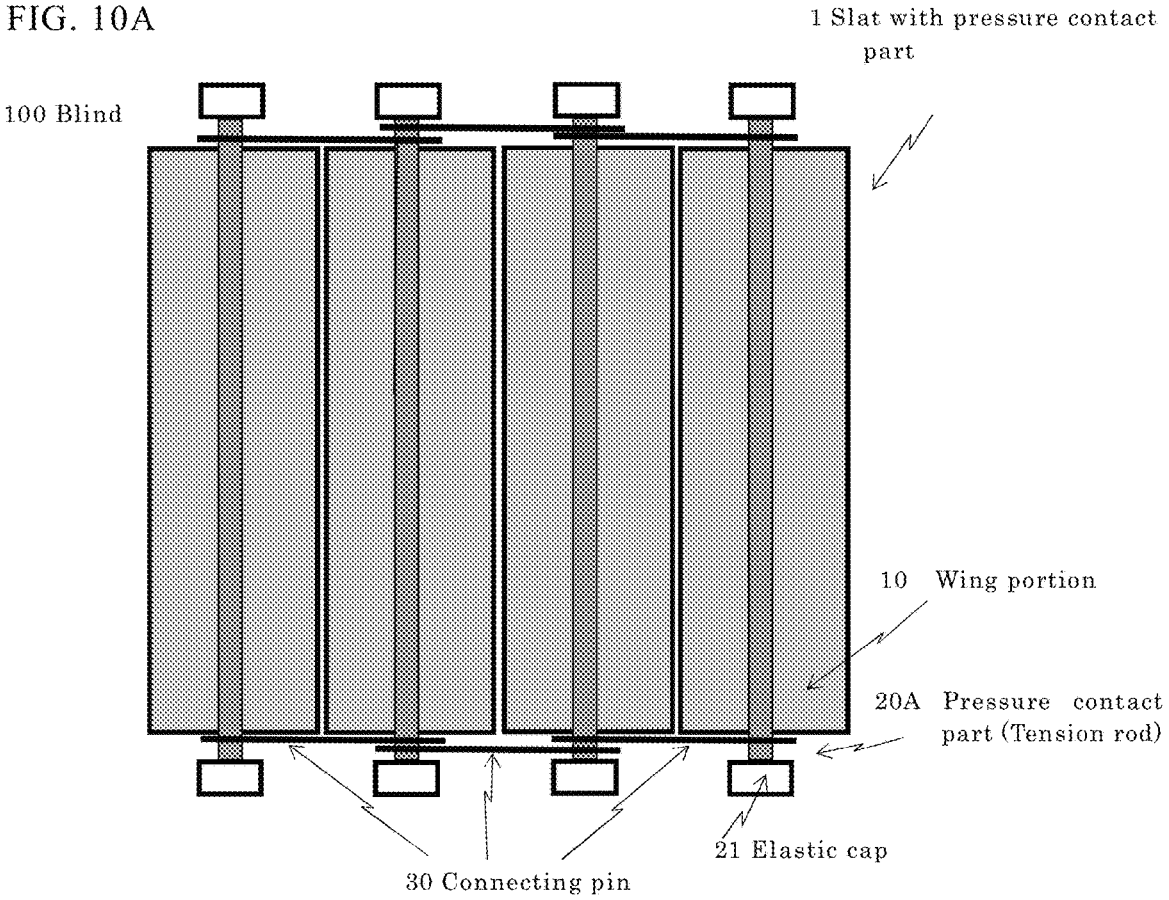
FIGS. 10A-10C is a front view illustrating a connecting pin and a blind that is constituted by connecting a plurality of slats with pressure contact parts according to at least an embodiment of the present invention using the connecting pin.
Figure 10B:
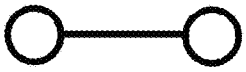
Figure 10C:
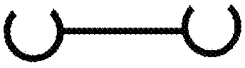

As described above, the blind 100 according to at least an embodiment of the present invention has the advantage of being configured by the necessary number of the slats 1 with pressure contact parts at the necessary intervals depending on the width of a window frame. At this time, if the slats 1 with pressure contact parts are provided at regular intervals, slats 1 may be mutually connected with connecting pins 30 provided between the wing portions 10 and the elastic caps 21 as shown in FIG. 10A. The connecting pin 30 may be made up of a wire or the like having rings formed at both ends as shown in FIG. 10*b*. When using these connecting pins, the elastic cap 21 is removed from the pressure contact part 20 (tension rod or the like) to attach the connecting pin 30 to the contact part 20, and then the elastic cap 21 is again attached to the contact part 20. Thereby, the user can assemble the blind 100 depending on his or her taste by rotating and pressing the elastic cap 21 against the opposing walls in the window frame. Alternatively, the connecting pin 30 may have another shape in which a part of the ring is chipped off as shown in FIG. 10C. In this case, adjacent slats 1 with pressure contact parts may be connected by fitting the connecting pin 30 to the pressure contact part 20 from the side thereof without removing the elastic cap 21.

Figure 11:
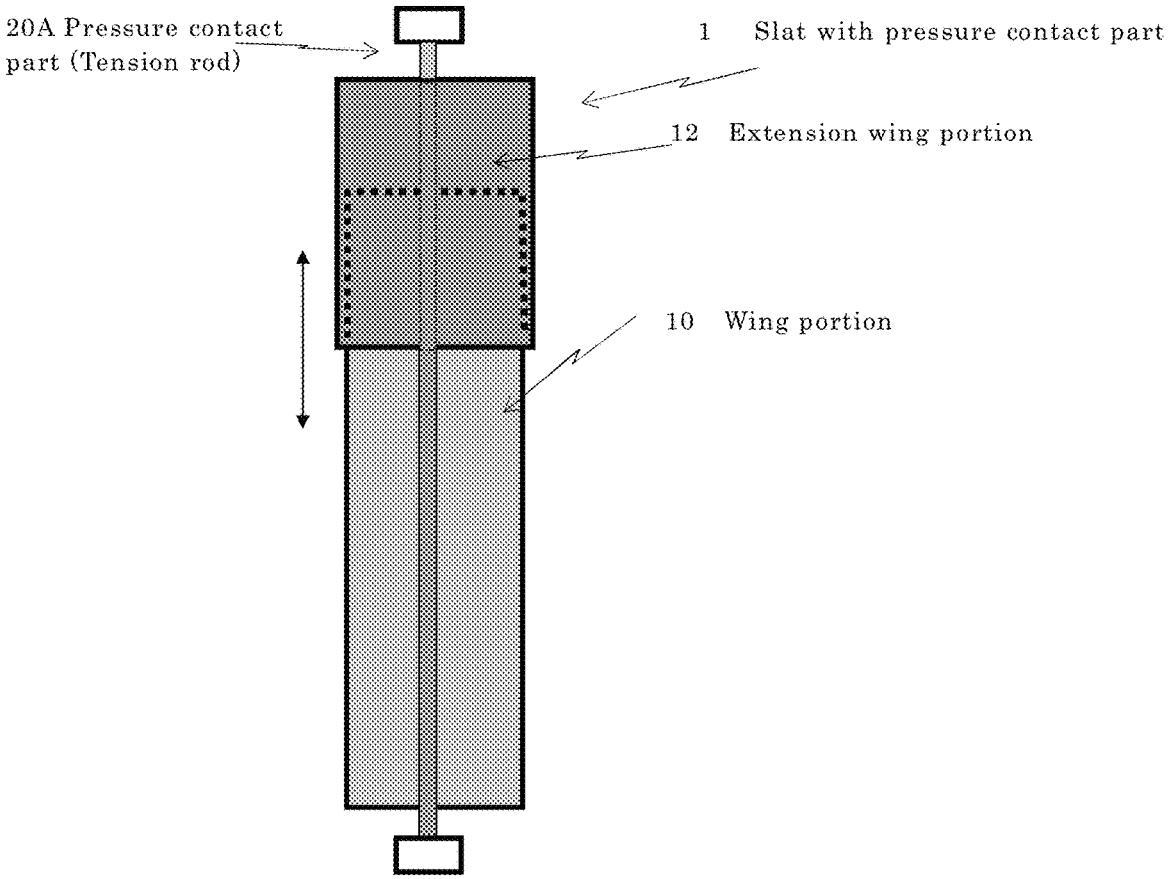
FIG. 11 is a front view illustrating the slat with a pressure contact part according to at least an embodiment of the present invention having an extension wing portion slidably attached to extend the length of the slat along a longitudinal direction thereof.

The slat 1 with a pressure contact part according to at least an embodiment of the present invention may be manufactured using, for example, a material that can be easily cut with scissors. When using such a material, if the length of the wing portion 10 of the blind 100 according to at least an embodiment of the present invention is too long with respect to the width of a window frame, the user can easily adjust the length of the wing portion 10 by himself or herself by cutting off the wing portion 10 with scissors. On the contrary, if the length of the wing portion 10 is too short, a slidable extension wing portion 12 can be added to the wing portion 10 in order to extend the length of the slat 1 with a pressure contact part along the longitudinal direction, as shown in FIG. 11. That is, the extension wing portion 12 is formed into a cylinder shape to sandwich the end of the wing portion 10 from the front and rear sides and is configured to be able to advance and retract along the longitudinal direction of the hollow cylinder 11. The extension wing portion 12, when retracted, is held by the wing portion 10 while fully covering the end of the wing portion 10, and when advancing, the extension wing portion 12 is slidingly moved along the arrow direction manually by an extended length while being held by the wing portion 10. The extension wing portion 12 is simply formed into a cylinder shape to sandwich the wing portion 10 without the hollow cylinder 11 differently from the wing portion 10, and thus is slidable along the longitudinal direction while covering the wing portion 10. As such, the slat 1 with a pressure contact part according to at least an embodiment of the present invention makes it possible to easily adjust the length by slidingly moving the extension wing portion 12 from the end of the wing portion 10 by the needed length when advancing the tension rod 20A to conform to the width between the opposing walls in the window frame. Therefore, the blind 100, in which a plurality of slats 1 with pressure contact parts is arranged at regular intervals, can be adapted to, for example, the vertical blind as shown in FIG. 1 by choosing the number of the slats 1 with pressure contact parts for the horizontal width, and by using the extension wing portion 12 for the vertical width, respectively, and thus can be flexibly applied to suit the size of a window frame. In this regard, the blind 100 has the advantage of having the significantly improved scene adaptability compared to conventional blinds with a factory-configured fixed size.

INDUSTRIAL APPLICABILITY

As described above, the user may purchase the necessary number of the slats 1 with pressure contact parts according to at least an embodiment of the present invention and assemble the blind 100 suitable for the size of the window frame depending on his or her taste, and therefore the slats 1 with pressure contact parts has broad marketability.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

The invention claimed is:

1. A slat for use in a window frame having opposing walls, the slat comprising:

a wing portion structured to block light, the wing portion having a first end in a longitudinal direction and a second end opposite to the first end; and a first pressure contact part provided at the first end and a second pressure contact portion provided at the second end, the first pressure contact part comprising a first face and the second pressure contact portion comprising a second face;

wherein the first face is a furthermost structure of the slat at the first end in the longitudinal direction;

wherein the second face is a furthermost structure of the slat at the second end in the longitudinal direction;

wherein the first face comprises a first face planar surface approximately perpendicular to the longitudinal direction and bound by a first face outer circumferential edge, the first face planar surface completely filling an area bound by the first face outer circumferential edge;

wherein the second face comprises a second face planar surface approximately perpendicular to the longitudinal direction and bound by a second face outer circumferential edge, the second face planar surface completely filling an area bound by the second face outer circumferential edge;

wherein the first pressure contact part is structured to press the first face against a first wall of the opposing walls, and the second pressure contact part is structured to press the second face against a second wall of the opposing walls, such that a first pressing force of the first face against the first wall and a second pressing force of the second face against the second wall hold the slat between the opposing walls;

wherein the slat is movable in a direction perpendicular to the longitudinal direction and configured to be held at any position within the window frame.

2. The slat according to claim 1, wherein at least one of the first pressure contact part and the second pressure contact part comprises an extendable and retractable tension rod comprising a slide lock mechanism, a screw mechanism, or an outer attachment structure;

wherein the wing portion is structured to pivot about an axis parallel to a length of the wing portion; and the slat is structured such that an opening and closing angle of the slat is flexibly adjusted by manually rotating the wing portion.

3. The slat according to claim 1, wherein the wing portion has a planar shape.

4. A blind for use in a window frame having opposing walls, the blind comprising:

a plurality of slats, each slat of the plurality of slats comprising:

a wing portion structured to block light, the wing portion having a first end in a longitudinal direction and a second end opposite to the first end; and a first pressure contact part provided at the first end and a second pressure contact portion provided at the second end, the first pressure contact part comprising a first face and the second pressure contact portion comprising a second face;

wherein the first face is a furthermost structure of the slat at the first end in the longitudinal direction;

wherein the second face is a furthermost structure of the slat at the second end in the longitudinal direction;

wherein the first face comprises a first face planar surface approximately perpendicular to the longitudinal direction and bound by a first face outer circumferential edge, the first face planar surface being continuous and completely filling an area bound by the first face outer circumferential edge;

wherein the second face comprises a second face planar surface approximately perpendicular to the longitudinal direction and bound by a second face outer circumferential edge, the second face planar surface being continuous and completely filling an area bound by the second face outer circumferential edge;

wherein the first pressure contact part is structured to press the first face of the first cap against a first wall of the opposing walls, and the second pressure contact part is structured to press the second face against a second wall of the opposing walls, such that a first pressing force of the first face against the first wall and a second pressing force of the second face against the second wall hold the slat between the opposing walls;

wherein the plurality of slats are spaced apart from each other;

wherein the slat is movable in a direction perpendicular to the longitudinal direction and configured to be held at any position within the window frame.

5. The blind according to claim 4, wherein the plurality of slats are mutually connected at a predetermined distance therebetween with a connecting pin structured to position the slats so as to be connected spaced apart from each other.

6. The blind according to claim 4, wherein the wing portion of each of the plurality of slats comprises a material that can be cut to conform to a distance between the opposing walls of the window frame;

the wing portion comprises a cylindrical extension wing portion that sandwiches the wing portion from front and rear sides at one end of the first end and the second end;

the extension wing portion is structured to extend and retract along the longitudinal direction of the wing portion; and the wing portion is structured to extend a length of the wing portion along the longitudinal direction to conform to the distance between the opposing walls of the window frame.

7. The slat according to claim 3, wherein a design is provided on a surface of the wing portion.

8. A blind for use in a window frame having opposing walls, the blind comprising:

a plurality of slats, each slat of the plurality of slats comprising:

a wing portion structured to block light, the wing portion having a first end in a longitudinal direction and a second end opposite to the first end; and a first pressure contact part provided at the first end and a second pressure contact portion provided at the second end, the first pressure contact part comprising a first face and the second pressure contact portion comprising a second face;

wherein the first face is a furthermost structure of the slat at the first end in the longitudinal direction;

wherein the second face is a furthermost structure of the slat at the second end in the longitudinal direction;

wherein the first pressure contact part is structured to press the first face of the first cap against a first wall of the opposing walls, and the second pressure contact part is structured to press the second face against a second wall of the opposing walls, such that a first pressing force of the first face against the first wall and a second pressing force of the second face against the second wall hold the slat between the opposing walls;

wherein the plurality of slats are spaced apart from each other;

wherein each slat of the plurality of slats is movable in a direction perpendicular to the longitudinal direction and configured to be held at any position within the window frame.

* * * * *